US007661875B2

(12) United States Patent
Verardo et al.

(10) Patent No.: US 7,661,875 B2
(45) Date of Patent: Feb. 16, 2010

(54) BALANCE FOR TIMEPIECE MOVEMENT

(75) Inventors: Marco Verardo, Les Bois (CH); Emmanuel Graf, La Chaux-de-Fonds (CH); Alexandre Füssinger, Wavre (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 11/690,259

(22) Filed: Mar. 23, 2007

(65) Prior Publication Data

US 2007/0222276 A1 Sep. 27, 2007

(30) Foreign Application Priority Data

Mar. 24, 2006 (EP) ..... 06111726

(51) Int. Cl.
*G04B 17/20* (2006.01)

(52) U.S. Cl. ..... 368/171; 368/202

(58) Field of Classification Search ..... 368/169–178, 368/202

See application file for complete search history.

(56) References Cited

U.S. PATENT DOCUMENTS 248,050 A * 10/1881 Miller ..... 368/169
759,914 A * 5/1904 Purgy ..... 368/171
1,350,035 A 8/1920 Povelsen
2,116,257 A * 5/1938 Aegler ..... 368/171
2,958,997 A * 11/1960 Jahn ..... 368/171

FOREIGN PATENT DOCUMENTS

| | | |
|---|---|---|
| CH | 276197 | 6/1951 |
| FR | 936.423 | 7/1948 |
| IT | 578680 | 6/1958 |

OTHER PUBLICATIONS

European Search Report issued in corresponding application No. 06 11 1726, completed Feb. 1, 2007.

* cited by examiner

*Primary Examiner*—Renee S Luebke
*Assistant Examiner*—Sean Kayes
(74) *Attorney, Agent, or Firm*—Griffin & Szipl, P.C.

(57) ABSTRACT

The balance comprising a felloe (3), arms (4) connecting the felloe (3) to the balance staff and inertia blocks (11) is characterized in that the felloe (3) includes studs (7) in its inner surface, a threaded hole (9) into which said inertia blocks (11) are screwed from the inside, without passing beyond the external surface of the felloe (3), passing through said felloe (3) and said studs (7).

12 Claims, 2 Drawing Sheets

BALANCE FOR TIMEPIECE MOVEMENT

This application claims priority from European Patent Application No. 06111726.3 filed Mar. 24, 2006, the entire disclosure of which is incorporated herein by reference.

FIELD OF THE INVENTION

The present invention concerns a balance for a timepiece movement, comprising a felloe and arms connecting the felloe to an arbour, to be associated with a balance spring to form, in a conventional manner, the mechanical oscillator, which determines the base frequency of a timepiece, in particular, a watch.

BACKGROUND OF THE INVENTION

Currently, a balance for a watch movement comprises a wheel-shaped part including the felloe (or rim), the arms and a certain arrangement of inertia blocks, which are secured to the felloe of the balance and which, by adjusting their positions, allow the unbalance and moment of inertia of the balance to be altered.

The oscillation frequency f of a sprung balance oscillator is given by the relation:

$$1/f=2\pi(I/M)^{0.5}$$

where I is the moment of inertia of the balance about its axis of rotation and M is the resilient couple of the balance spring, expressed in Nm/rad. The usual frequencies of watch oscillators range from 2.5 Hz to 5 Hz, by steps of 0.5 Hz so that a duration of one second corresponds to an integer number of oscillator vibrations. A movement is thus designed for a given frequency and the sprung balance assembly must have that frequency. In the above formula, it can be seen that the pertinent parameter of the balance is the moment of inertia. Since the role of the arms is very limited in the moment of inertia, the latter depends foremost upon the dimensions (diameter and cross section) and density of the felloe and the elements connected thereto.

In some cases, the designer of a timepiece movement may wish to use a balance of relatively large diameters, for example for aesthetic reasons. Increasing the diameter without changing the moment of inertia can be achieved either by decreasing the cross section of the felloe or by using a less dense material. In both cases, the balance will have less mass, which reduces friction in the bearings, and thus interference with the isochronism of the balance depending upon the positions (vertical and horizontal) of the movement. However, a felloe of reduced cross section becomes too weak, especially if it has to carry the adjusting inertia blocks.

SUMMARY OF THE INVENTION

It is an object of the present invention to achieve a sprung balance oscillator having a larger diameter than is usual, limited at the external contour of the felloe for the same frequency, or with a higher frequency with the same dimensions as a usual oscillator, while avoiding the aforementioned drawbacks.

It is also an object of the invention to provide a balance of reduced mass in order to increase the chronometric performance of the watch to which it is fitted for a given balance inertia.

A balance according to the invention is thus characterized in that the felloe comprises studs directed inwards, a threaded hole passing through the felloe and the studs, with inertia blocks screwed into the hole from the inside, having a thread length such that the ends of the inertia blocks to not extend beyond the external surface of the felloe. The studs and the inertia blocks extend from the inner surface of the felloe and are preferably regularly distributed inside the latter. These studs can be located between the arms or in recesses provided at the junction between the arms and the felloe.

Thus, in accordance with a first embodiment of the invention, a balance for a timepiece movement includes: (a) a felloe, (b) arms connecting the felloe to the balance staff and (c) inertia blocks for adjusting the unbalance and regulating the moment of inertia, wherein the felloe includes studs directed inwards, a threaded hole into which the inertia blocks are screwed from the inside, passing through the felloe and the studs. In accordance with a second embodiment of the invention, the first embodiment is modified so that the studs are directed radially inwards. In accordance with a third embodiment of the invention, the first embodiment or the second embodiment is further modified so that the studs are arranged on the inner surface of the balance felloe. In accordance with a fourth embodiment of the invention, the first embodiment or the second embodiment is further modified so that the studs are arranged on one of the frontal surfaces of the balance felloe. In accordance with a fifth embodiment of the invention, the first embodiment is modified so that the length of the thread corresponds to the maximum travel of the inertia blocks defined by the width of the studs and the felloe, without passing beyond the exterior of the felloe. In accordance with a sixth embodiment of the invention, the first embodiment is modified so that the studs are arranged between the arms. In accordance with a seventh embodiment of the invention, the first embodiment is modified so that the studs are arranged in recesses provided in the arms.

BRIEF DESCRIPTION OF THE DRAWINGS

Other peculiarities of the invention will appear in the following description of -an embodiment of a balance for a watch movement, given by way of non-limiting example with reference to the annexed drawings, in which.

DETAILED DESCRIPTION OF ONE EMBODIMENT OF THE INVENTION

Figure 1:
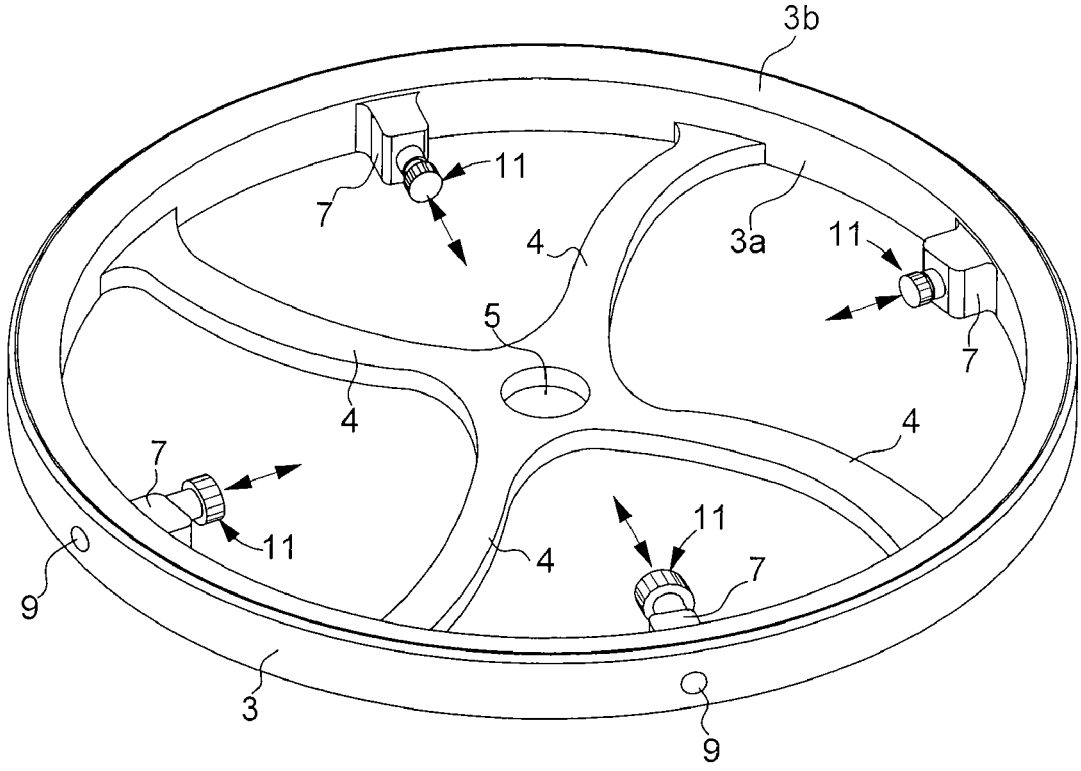
FIG. 1 is a perspective view of the balance.
Figure 2:
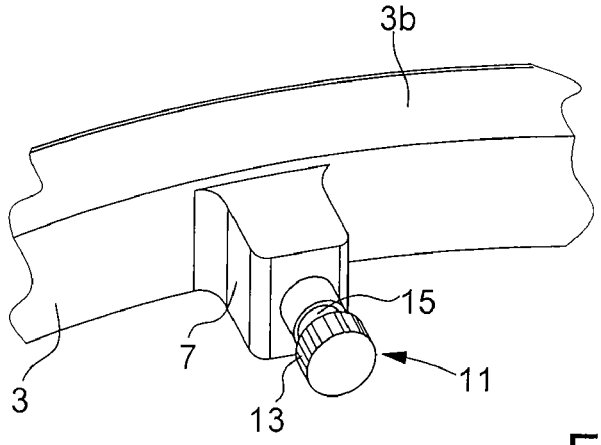
FIG. 2 is an enlarged view of an inertia block.
Figure 3:
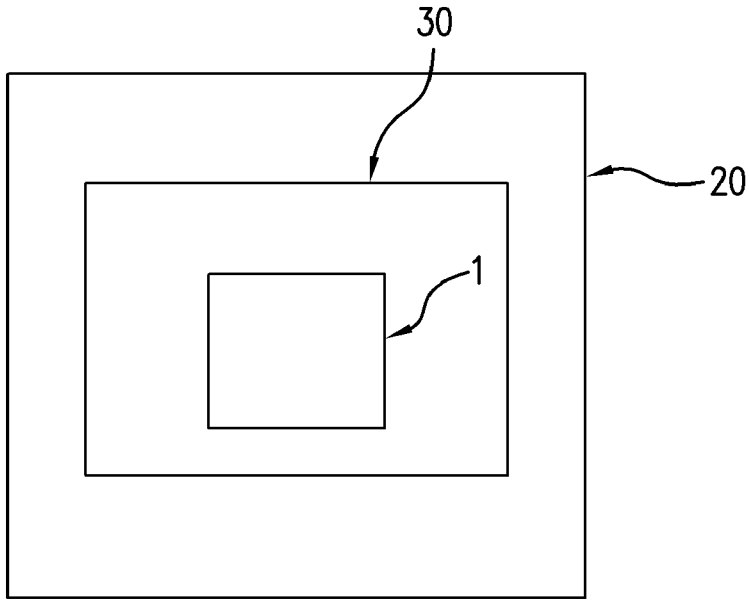
FIG. 3 is a schematic diagram showing a timepiece (20) that includes a timepiece movement (30), which includes the balance (1)

The balance 1 shown in FIGS. 1 and 2 comprises a balance wheel including a felloe 3 and for example four arms 4 integral with felloe 3. Arms 4 radiate from a central pierced part 5 which is driven onto a balance staff (not shown). As can be seen, the inner surface 3*a* of felloe 3 includes studs 7, which, in this example are regularly distributed between arms 4. It should be noted that any other distribution of the studs could be envisaged by those skilled in the art. These studs 7 can be integral with felloe 3, or elements that are added by any means known to those skilled in the art, for example, by welding, screws etc. If the studs are added on, one could envisage making the studs and the felloe in different materials, for example the felloe could be made of CuBe and the studs of titanium in order to further minimise the mass. A threaded hole 9 passes through felloe 3 and studs 7. Threaded holes 9 are provided for screwing in, from inside felloe 3, inertia blocks 11, whose radial movement indicated by the arrows, will enable the unbalance and moment of inertia to be adjusted. These inertia blocks 11 are formed by screws whose head preferably has a milled portion 13 facilitating handling and whose threaded stem 15 has a length such that, for a maximum moment of inertia (with the screw fully tightened) the end thereof does not pass beyond the external surface of felloe 3. According to a variant that is not shown, studs 7 can be arranged in recesses provided on the arms.

Figure 4:
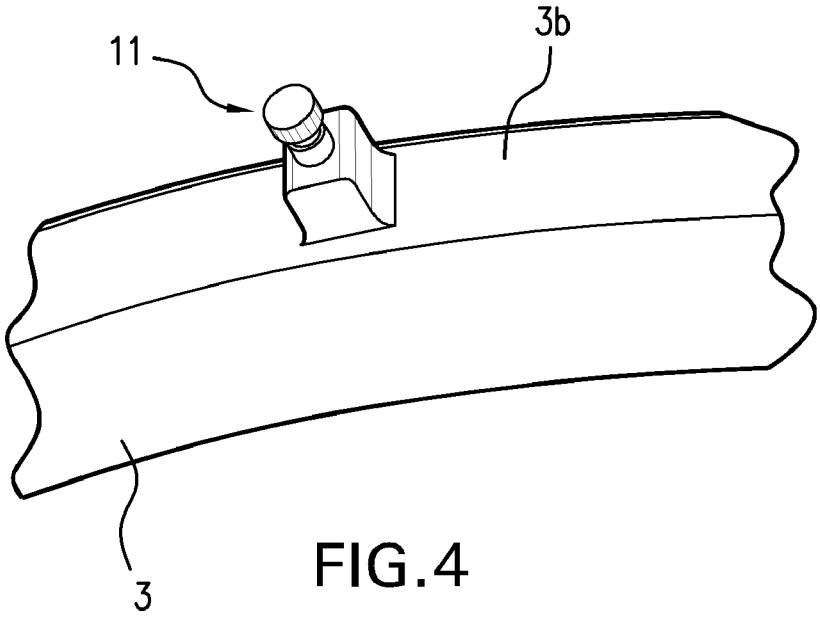
FIG. 4 is an enlarged view of an inertia block in accordance with another embodiment of the present invention.

From the description that has just been given, those skilled in the art can devise multiple variants of the balance without departing from the scope of the invention defined by the claims. For example, according to a variant, studs 7 could be arranged not on the inner surface 3*a* of felloe 3 but on one of the two frontal surfaces 3*b* of the felloe (See FIG. 4), provided that they do not pass beyond the external circumference of felloe 3.

What is claimed is:

1. A balance for a timepiece movement, the balance including:

(a) a balance felloe; and (b) arms connecting the felloe to a balance staff and inertia blocks for adjusting an unbalance and regulating moment of inertia, wherein the arms are integral with the felloe, wherein the felloe includes i. studs directed inwards; and ii. threaded holes into which the inertia blocks are screwed from the inside, wherein each hole passes through the felloe and a stud, wherein the studs are integral with the felloe or are fixed to the felloe in a non-movable manner.

2. The balance according to claim 1, wherein the studs are arranged on an inner surface of the balance felloe.

3. The balance according to claim 1, wherein the studs are arranged on one of frontal surfaces of the balance felloe.

4. The balance according to claim 1, wherein each inertia block has a threaded stem, and the length of thread of the threaded stem corresponds to the maximum travel of the inertia block defined by the width of the studs and the felloe, without passing beyond an exterior of the felloe.

5. The balance according to claim 1, wherein the studs are arranged between the arms.

6. The balance according to claim 1, wherein the studs are arranged in recesses provided in the arms.

7. The balance according to claim 1, wherein the studs are directed radially inwards.

8. The balance according to claim 7, wherein the studs are arranged on an inner surface of the balance felloe.

9. The balance according to claim 7, wherein the studs are arranged on one of frontal surfaces of the balance felloe.

10. A timepiece comprising a timepiece movement, wherein the timepiece movement includes the balance according to claim 1.

11. A balance for a timepiece movement, the balance including:

(a) a balance felloe; and (b) arms connecting the felloe to a balance staff and inertia blocks for adjusting an unbalance and regulating moment of inertia, wherein the arms are integral with the felloe, wherein the felloe includes i. studs directed inwards; and ii. threaded holes into which the inertia blocks are screwed from the inside, wherein each hole passes through the felloe and a stud, wherein the studs are integral with the felloe or are fixed to the felloe in a non-movable manner, wherein the studs are fixed to the felloe in a non-movable manner, and the studs are made of a different material than the felloe.

12. The balance according to claim 11, wherein the studs comprise titanium and the felloe comprises CuBe.

* * * * *